US005361927A

United States Patent [19]

Frei

[11] Patent Number: 5,361,927

[45] Date of Patent: Nov. 8, 1994

[54] DAMPED HINGE MOUNTING MECHANISM

[75] Inventor: Max Frei, Oakdale, Minn.

[73] Assignee: Max Display Fixtures & Woodworks, North Hudson, Wis.

[21] Appl. No.: 84,539

[22] Filed: Jun. 28, 1993

[51] Int. Cl.[5] ..... B65D 45/00

[52] U.S. Cl. ..... 220/334

[58] Field of Search ..... 220/334, 335, 342

[56] References Cited

U.S. PATENT DOCUMENTS

| | | | |
|---|---|---|---|
| 3,780,904 | 12/1973 | Stanford | 220/334 |
| 3,782,592 | 1/1974 | Bergh et al. | 220/334 |
| 4,152,979 | 5/1979 | Schmidt | 220/334 |
| 5,067,625 | 11/1991 | Numata | 220/334 |
| 5,097,976 | 3/1992 | Zink et al. | 220/334 |

OTHER PUBLICATIONS

*Baer Supply Company Catalog, 1991,* cover page and pp. B-250 through B-255, labelled Exhibit A.

*Baer Supply Company Catalog, 1991,* cover page and p. B-259, labelled Exhibit B.

*Sugatsune America, Inc. Instruction Manual: A Lapcon Series Product,* one-page, labelled Exhibit C.

*Primary Examiner*—Joseph Man-Fu Moy

*Attorney, Agent, or Firm*—Merchant, Gould, Smith, Edell, Welter & Schmidt

[57] ABSTRACT

A damped hinge and angled mounting bracket are provided to mount the damped hinge to a bin so that the lid of the bin opens freely and closes in a damped fashion. The damped hinge includes a housing and a sprocket support. The sprocketed support connects to a supporting wall. The angled mounting bracket includes a first leg and a second leg. The first leg mounts to a lid of the bin, and the second leg fastens to the housing of the damped hinge. The lid then moves freely to an open position and in a damped fashion to its closed position.

8 Claims, 3 Drawing Sheets

DAMPED HINGE MOUNTING MECHANISM

TECHNICAL FIELD

This invention relates generally to bins, containers, and display cases, but more specifically relates to a compact and durable damped hinge arrangement: which operates to allow a lid of a container to be opened freely and closed in a damped fashion.

BACKGROUND OF THE INVENTION

Ordinarily, baked goods such as pastries, doughnuts and bagels become stale when exposed for extended periods to the humidity in the air. Clear display cases are used in grocery stores and other markets to allow the public to see items for sale without such items becoming stale. Often such display cases are fabricated from acrylic.

In the past, baked goods were kept "behind the counter". Such counter displays have transparent fronts and are accessible from the rear. Counter displays require additional employees to serve the customer and create unneeded delays for the customer in purchasing his/her goods. Also, such displays create additional costs which the market must bear to pay the extra employees. Because of the delays and the added costs associated with "behind the counter" arrangements many stores now place their baked goods in bins or containers which were accessible by the public.

Such bins present new problems. Bins which include sliding doors are often left open by customers after baked goods are taken out. Many state health codes require the lids of bins to remain closed when not in use. If a door stays open there is a health code violation, and the goods can become stale.

Because a large portion of state health codes require the lids of bins to close after use, many stores use bins having lids fastened to the bin by an ordinary hinge which remains closed due to gravity. Such bins are awkward as the customer needs to hold the lid open while selecting his/her goods. While the lid always closes after the goods are removed, the lid often slams shut on the customer's hand or head.

Many stores attempted to solve the problem of lids slamming on customers by including a latch for holding the lid open. The customer would merely open the lid, latch it in place, take his/her goods, unlatch the lid, and close the lid. However, like the bins with sliding doors, many customers, after opening and latching the lid, would not unlatch and close the lid. With the lid in the open position health codes may be violated, and the baked goods in the bin would become stale.

In the prior art, damped hinge arrangements are not compact enough to be useful in the small confines of a baked goods display case. Recently, a relatively small damped hinge arrangement became available which would allow a lid to be easily opened, while closing slowly. This arrangement is marketed by Sugatsune America, Inc. located at 221 East Selandia Lane, Carson, Calif., 90746. The Sugatsune damped hinge includes a ratchet mechanism and an annular rubber ring disposed between two sets of plates with an extending pivoted arm. The damped hinge includes a sprocketed support freely mobile to its open position and damped to its closed position. The sprocketed support of the damped hinge is attached to a side wall of a container and the pivoted arm is attached to the lid. The lid opens freely and closes in a damped fashion.

Unfortunately, the pivoted arm of the Sugatsune product often breaks if excessive force is applied to the lid to close it. Often, lids on bins used to store baked goods are slammed or abruptly opened by customers, which creates high or excessive forces. Therefore, a need exists to provide a durable yet compact mechanism which allows a lid of a bin to open easily and close slowly.

The bins/containers of the prior art do not disclose an apparatus which allows the bin to be opened freely and closed in a damped fashion, while being durable enough to withstand repeated abuse from customers. The present invention provides such a device.

SUMMARY OF THE INVENTION

According to a preferred embodiment of the present invention, a bin is provided with a lid having a damped hinge. The damped hinge includes a housing and a sprocketed support freely rotatable to an open position, and damped to a closed position. The damped hinge is mounted to a supporting wall and the lid by an angled bracket having a first leg and a second leg. The sprocketed support is directly mounted to the supporting wall and the second leg of the angled bracket is mounted to the damped hinge. The first leg is mounted to the supporting wall such that the lid opens freely and closes in a damped fashion.

A spacer puck can also be provided between the sprocketed support and the supporting wall. In the preferred embodiment, a pressure bolt and nut are used to connect the second leg of the angled bracket to the lid.

In the preferred embodiment, the damped hinge and mounting arrangement are used in a bin or container used to display baked goods. The container includes a base, two substantially parallel side walls extending perpendicularly from the base, and two connecting walls between the side wall to form the container, and a lid sealing the container. The first leg of the angled bracket is fastened to the lid by a pressure bolt, and the damped hinge is fastened to the damped hinge. The supporting sprocket is fastened to a spacer puck which is in turn fastened to one of the side walls. Two damped hinges may be provided.

DETAILED DESCRIPTION OF THE PREFERRED EMBODIMENT

Figure 1:
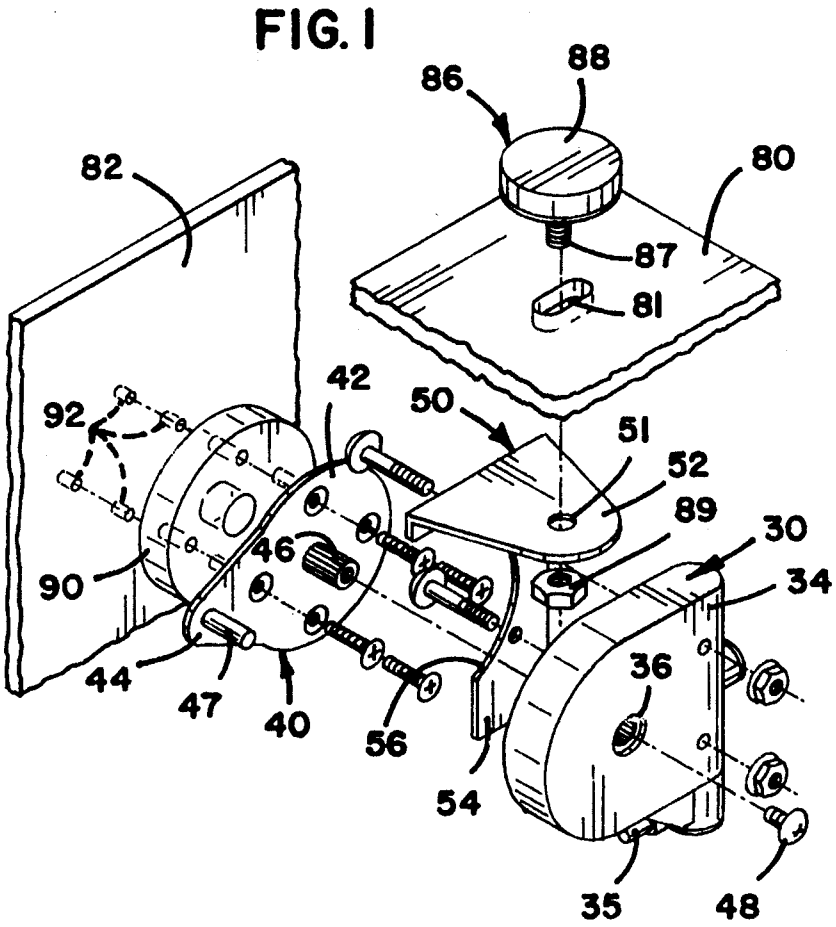
FIG. 1 is a breakaway view of the damped hinge and mount.

Referring to the figures, wherein like reference numerals designate identical or corresponding parts throughout the several figures is shown in the damped hinge mechanism and bin of the present invention.

Shown in FIG. 1 is a break-away of the improved damped hinge and mounting arrangement. Damped hinge 30 comprises a relatively planar body 31 with a circular upper profile 32 and a rectangular lower profile 34.

Damped hinge 30 includes aperture 36 adapted to receive sprocketed support 40. Sprocketed support 40 comprises planar disc 42 with a planar side section 44 extending therefrom. A driving post 46 extends substantially perpendicularly from the center of planar disc 42 into aperture 36 of damped hinge 30. A threaded fastener 48 locks driving post 46 in aperture 36. Additionally, stop 47 extends from section 44 in a direction substantially parallel to post 46.

Figure 2:
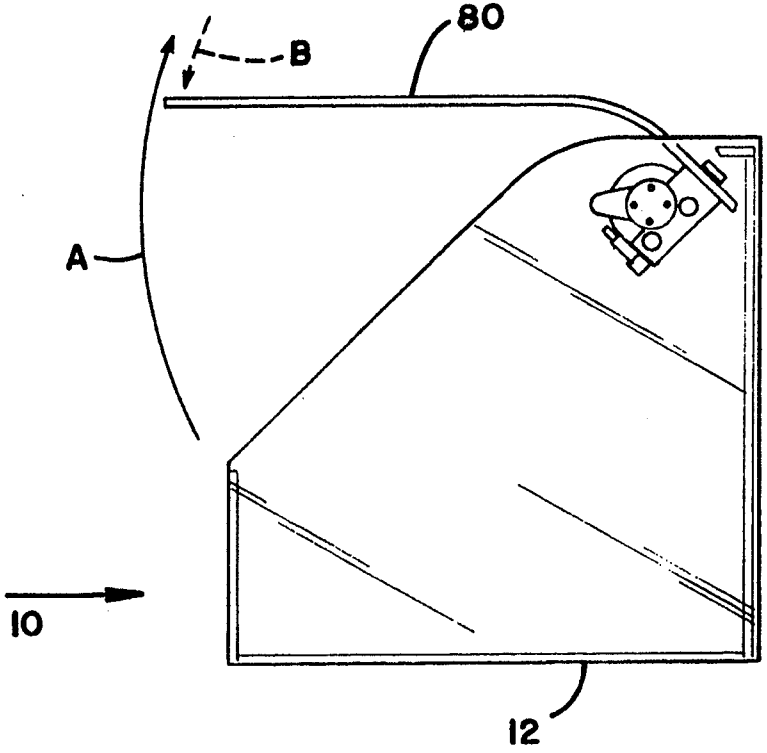
FIG. 2 is a side view of a bin in its open position.
Figure 3:
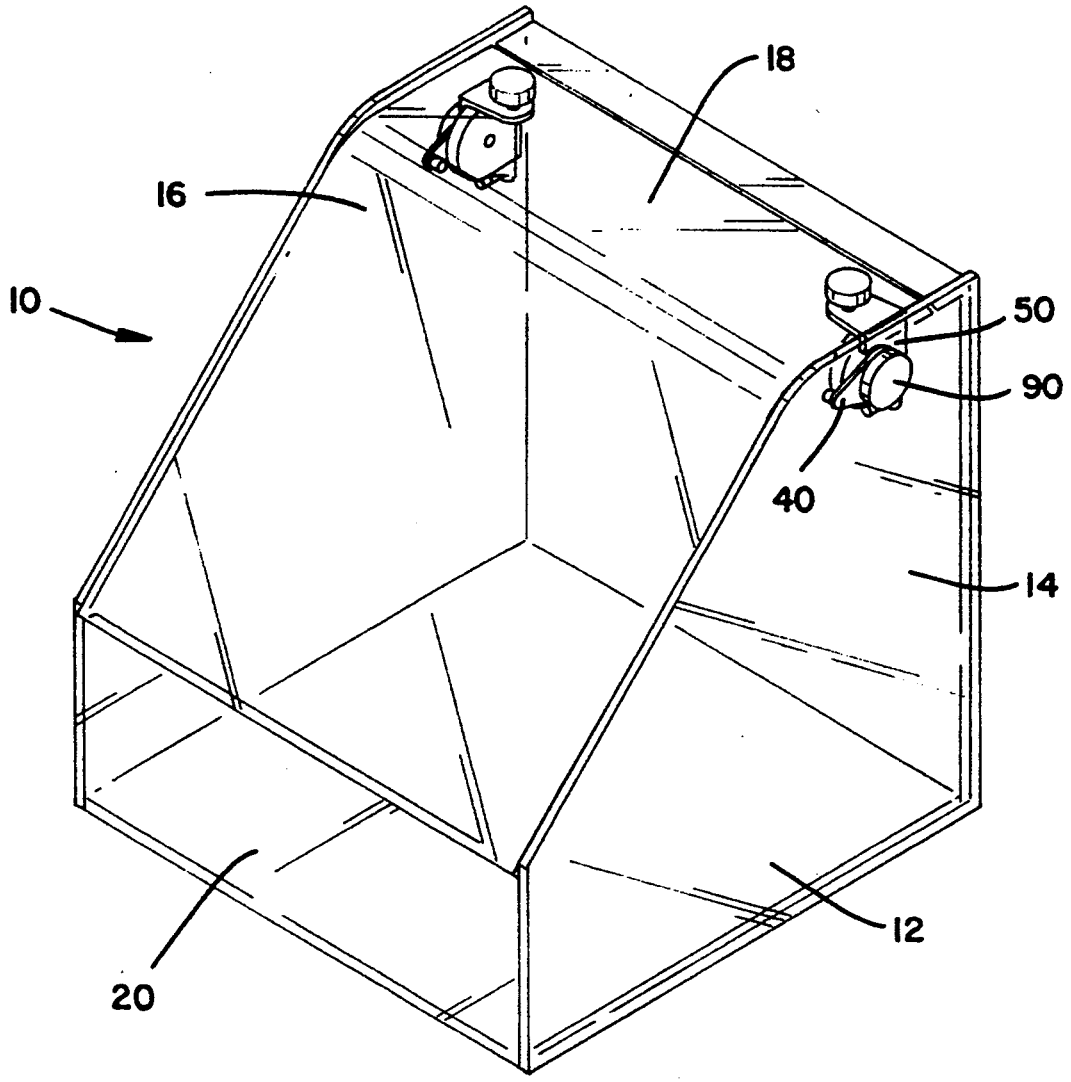
FIG. 3 is a perspective view of the bin of the preferred embodiment.
Figure 4B:
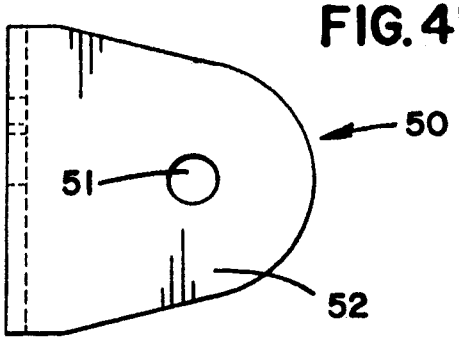
FIG. 4*b* is a top plan view of the first leg of the angled mounting bracket.
Figure 4A:
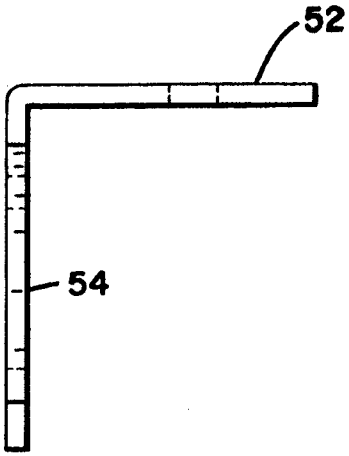
FIG. 4*a* is a side elevation view of angled mounting bracket.
Figure 4C:
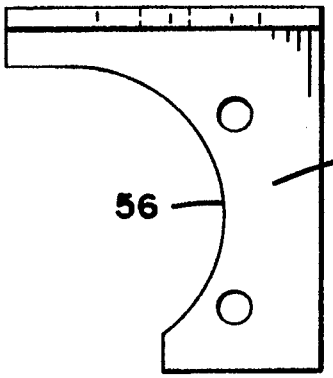
FIG. 4*c* is a front elevation view of the second leg of the angled mounting bracket.

Damped hinge 30 rotates freely to about the axis of post 46 an open position (shown in FIG. 2) and is damped to its closed position (shown in FIG. 3). Damped hinge 30 rotates freely until stop 47 of sprocketed support 40 contacts post 35 of damped hinge 30. The amount damped hinge 30 rotates before reaching open position 25 can be adjusted by increasing or decreasing the length of post 35.

Angled bracket 50 operates to connect damped hinge 30 to lid 80 in a compact and highly durable manner. Angled bracket 50 includes first leg 52 which preferably has a triangular profile, and second leg 54 which preferably has a rectangular profile with a semicircular cutout 56. Semicircular cut-out 56 of second leg 54 provides clearance between sprocketed support 40 and angled bracket 50.

In the preferred embodiment shaped first leg 52 of angled mounting bracket 50 attaches to lid 80 by a pressure bolt 86. Preferably, first leg 52 has an aperture 51 and lid 80 has a slot 81. Shaft 87 of pressure bolt 86 fits in slot 81 of lid 80 and aperture 51 of angled mounting bracket 50. A nut 89 attaches to shaft 87. Pressure bolt 86 and first leg 52 of angled mounting bracket 50 face each other through lid 80. Pressure bolt 86 includes a wide head 88 operable in dispersing mounting forces about lid 80 and forces associated with opening and closing lid 80.

In the preferred embodiment the lid is made out of acrylic. Acrylic is preferred because it is transparent and relatively easy to work with. However acrylic susceptible to cracking or splitting due to excess shear forces. Wide head 88 of pressure bolt 86 facing the first leg 52 of angled mounting bracket 50 tends to distribute forces over a relatively large area on lid 80, thus decreasing pressure. Lower pressures aid in preventing the acrylic from splitting. Additionally, when lid 80 opens and closes, increased forces are dispersed; also preventing the acrylic from splitting. Slot 81 allows the damped hinge and mounting arrangement to be adjusted so that lid 80 can properly mate with its bin. Slot 81 also decreases splitting because shaft 87 of pressure bolt 86 does not completely contact acrylic lid 80.

In the preferred embodiment sprocketed support 50 mounts to supporting wall 82 of bin 10 through a disc-shaped spacer puck 90. In such an arrangement sprocketed support 50 remains fixed while damped hinge 30 rotates to move lid 80 between open position and closed position as shown by arrows A and B, respectively in FIG. 2. Spacer puck 90 is a solid acrylic cylinder and mounts between supporting wall 82 and sprocketed support 40. Fastening sprocketed support 40 to spacer puck 90 can be accomplished by a plurality of threaded fasteners 92. Spacer puck 90 maintains damped hinge 30 away from supporting wall 82. The space between damped hinge 30 and supporting wall 82 allows the bin to be completely cleaned.

Figure 5:
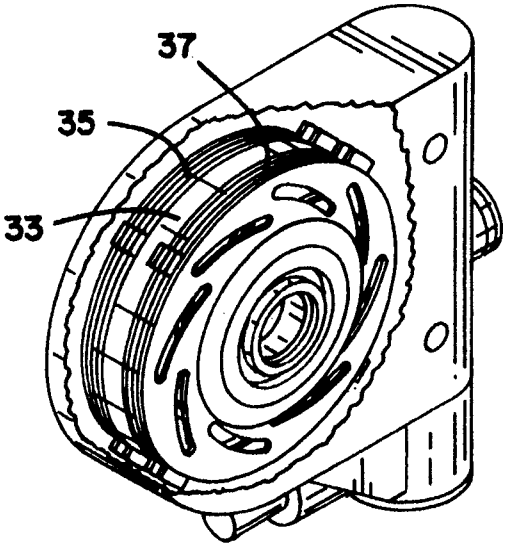
FIG. 5 is a cut-away perspective view of a damped hinge of the prior art modified according to the present invention.

As best seen in FIG. 5, the internal mechanism of damped hinge 30 allows free movement to open position 25 and damped movement to closed position 27. The mechanism includes fixed plates 35,37 spaced by rubber ring 33. The device contains a viscous fluid for dampening.

Such a damped hinge is available from Sugatsune America, Inc. located at 221 East Selandia Lane, Carson Calif., 90746, marketed under the trademark LAMP. As purchased the damped hinge includes a pivoted arm operable in connecting the damped hinge to a lid. The sprocketed support attaches to a supporting wall while the pivoted arm attaches to the lid. To use the Sugatsune damped hinge in the present invention, the arm must be removed and different mounting means must be provided. As best shown in FIG. 1 the damped hinge of the present invention does not include the pivoted arm of the prior art.

The present arrangement provides advantages not available in the prior art. The present invention will allow lid 80 of bin 10 to remain in open position 25 long enough for the customer to remove baked goods without remaining open or slamming on the customer. Because of the simplified construction over the Sugatsune damped hinge, the present damped hinge arrangement will not break or cause an acrylic lid to split. The present invention is easier to clean as the spacer puck maintains sprocketed support 40 and damped hinge 30 away from supporting wall 82. Additionally, the present damped hinge and mounting arrangement improves the visual appearance of the bin, which aids in selling goods.

For purposes of illustration a completed bin is shown in FIGS. 2 and 3. Bin 10 includes base 12 from which substantially parallel side walls 14 and 16 extend vertically therefrom. An area to store goods is formed by substantially parallel connecting walls 18 and 20 located between side walls 14 and 16. Lid 80 is constructed in a sloped fashion between connecting wall 18 and connecting wall 20. Attached to the each side wall proximate connecting wall 18 is spacer puck 90 and sprocketed support 40, as shown in FIG. 3. Driving post 46 of sprocketed support 40 engages damped hinge 30 at aperture 36. Damped hinge 30 connects to angled bracket 50 as described above, and angled bracket 50 attaches to lid 80 via pressure bolt 86 as described above.

For smaller bins, a pin (not shown) is placed between one side wall and the lid on one side and the damped hinge arrangement may be maintained on the other side wall.

It should be recognized that a wide variety of bin configurations can be accomplished utilizing the teachings of the above damped hinge arrangement. For example in certain applications the base may be eliminated. Also a plurality of bins may be connected together such that they have common side walls.

The present damped hinge arrangement will operate in any environment requiring a compact and durable damped hinge arrangement and should not be limited to acrylic cases or baked goods display cases.

What is claimed is:

1. A damped hinge and mounting mechanism which comprises:

(a) a damped hinge including a housing and a sprocketed support, said sprocketed support freely mobile in an opening direction and damped in a closing direction, said sprocketed support including means for fastening to a supporting wall of a container; and (b) an angled member having a first Leg and a second leg positioned at a fixed angle apart from said first leg, said first leg including means for fastening to a lid and said second leg including means for fastening to said housing of said damped hinge.

2. A damped hinge as in claim 1 further comprising a spacer puck fastened between said sprocketed support and said supporting wall.

3. A damped hinge as in claim 2 wherein said means to mount said first leg of said angled bracket to said lid comprises a pressure bolt and a nut attached thereto.

4. A containers which comprises:

(a) a lid;

(b) a first side wall;

(c) a second side wall substantially parallel to said first side wall;

(d) an angled bracket having a first leg and a second leg, said first and second legs positioned at a fixed angle apart, said first leg fastened to said lid; and (e) a first damped hinge including a housing and a sprocketed support, said damped hinge freely mobile in an opening direction and damped in a closing direction, said housing of said damped hinge fastened to said second leg of said angled bracket and said sprocketed support fastened to said first side wall.

5. A container as in claim 4 further comprising:

(a) a second angled member having a first leg and a second leg said first leg fastened to said lid; and (b) a second damped hinge including a housing and a sprocketed support, said damped hinge freely mobile in an opening direction and damped in a closing direction and said second leg of said second angle member fastened to said housing of said second damped hinge and said sprocketed support fastened to said second side wall.

6. A container as in claim 4 wherein said first leg of said angle member is attached to said lid with a threaded fastener including a pressure block proximate said lid.

7. A container as in claim 4 further comprising:

(a) a spacer puck disposed between said sprocketed support and said side wall.

8. A container which comprises:

(a) a base;

(b) a first side wall extending substantially perpendicular to said base;

(c) a second side wall extending substantially perpendicular from said base and parallel to said first side wall;

(d) a pair of connecting walls extending substantially perpendicular to said base in a parallel fashion;

(e) a lid operative in creating a substantially enclosed space between said first and second side walls and said connecting walls;

(f) a pair of angled members each having an associated first leg and second leg, said first and second legs of each of said angled member positioned at a fixed angle apart, said first leg of each of said angled members fastened to said lid; and (g) a pair of damped hinges, each damped hinge including a housing and a sprocketed support, said damped hinge freely mobile in an opening direction and damped in a closing, each of said housings fastened to said second leg of each of said angle members and each of said sprocketed supports fastened to said first and second side walls so that said lid moves freely to its open position and is damped in its closed position.

* * * * *